US005345805A

United States Patent [19]

Hauck

[11] Patent Number: 5,345,805

[45] Date of Patent: Sep. 13, 1994

[54] ROLLING MILL FOR WIRE OR BAR STEEL WITH A CONTINUOUS LIGHT SECTION STEEL OR WIRE TRAIN

[75] Inventor: Albert Hauck, Hilchenbach, Fed. Rep. of Germany

[73] Assignee: SMS Schloemann-Siemag Aktiengesellschaft, Düsseldorf, Fed. Rep. of Germany

[21] Appl. No.: 65,097

[22] Filed: May 19, 1993

[30] Foreign Application Priority Data

May 23, 1992 [DE] Fed. Rep. of Germany ..... 4217149

[51] Int. Cl.[5] ..... B21B 1/18; B21B 41/06

[52] U.S. Cl. ..... 72/201; 72/230; 72/234

[58] Field of Search ..... 72/201, 227, 234, 230, 72/231

[56] References Cited

U.S. PATENT DOCUMENTS

| | | | |
|---|---|---|---|
| 820,396 | 5/1906 | Daniels | 72/234 |
| 1,307,156 | 6/1919 | Smith | 72/227 |
| 3,197,993 | 8/1965 | Hein et al. | 72/234 |
| 5,050,418 | 9/1991 | Grotepass | 72/201 |

*Primary Examiner*—Lowell A. Larson

*Assistant Examiner*—Thomas C. Schoeffler

*Attorney, Agent, or Firm*—Anderson Kill Olik & Oshinsky

[57] ABSTRACT

A rolling mill for wire or bar steel with a continuous light section steel or wire train, comprising a single or multi-line breakdown train with pilot stands, at least one single intermediate train comprising a cooling distance with subsequent soaking distance and a group of intermediate stands located downstream of said breakdown train as well as a finishing train downstream of said intermediate train with a single line group of finishing stands is disclosed, for overcoming unequal temperature distributions across the bar length and cross-section to compensate for varying finishing velocities because of cross-sectional differences caused by unavoidable longitudinal pull between the stands of the breakdown train. Specifically, a first soaking or compensation distance 10 with 180° loop of the rolled stock guided through the horizontal loop former is located between the pilot stand and the group of intermediate stands and a second compensation or soaking distance with 180° loop of the rolling stock formed by a second horizontal loop former is disposed between the group of intermediate stands and the finishing stands.

4 Claims, 1 Drawing Sheet

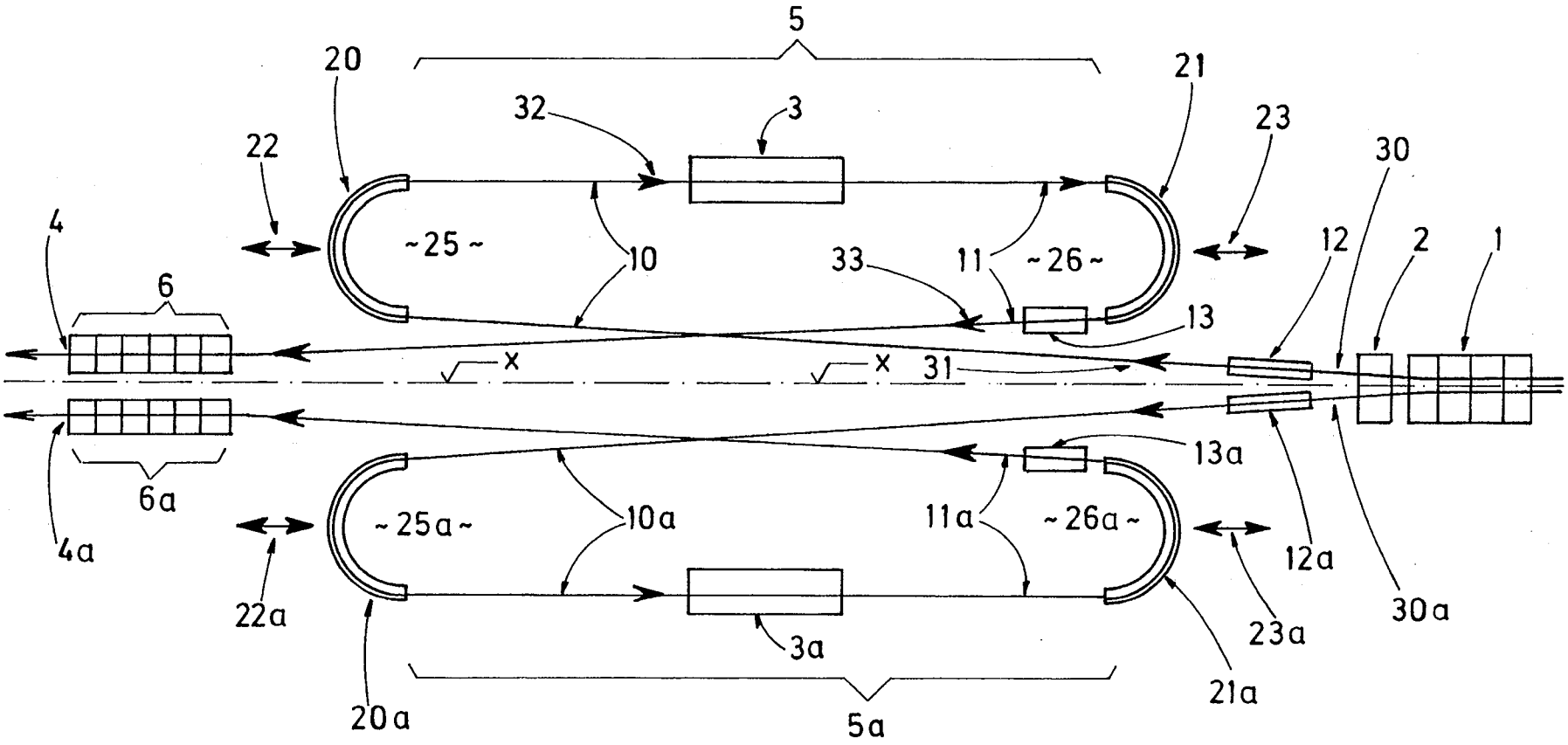
1
2
30
30a
12
12a
23
23a
21
21a
13
13a
~26~
~26a~
11
11a
31
33
X
X
5
5a
3
3a
10
10a
32
~25~
~25a~
20
20a
22
22a
6
6a
4
4a

ROLLING MILL FOR WIRE OR BAR STEEL WITH A CONTINUOUS LIGHT SECTION STEEL OR WIRE TRAIN

FIELD OF THE INVENTION

The present invention deals with a rolling mill for wire or bar steel with a continuous light section steel or wire train.

BACKGROUND OF THE INVENTION

The problems resulting from uneven temperature distributions across the bar length and cross-section increase with high finish-rolling velocities in modern wire and steel bar trains with large initial pass sections. In a multi-line train, floating or reciprocating finish velocities are additionally observed, resulting from the differing rolling stock cross-sections in the multi-line area of the train, which results in a rapid velocity regulation of the installation portions disposed behind the pilot stand. The difficulties can increase to such an extent that the finish-rolling velocity must be reduced. For rolling stock exiting from the pilot stand, its cross-section fluctuates because of the unavoidable longitudinal pull between the stands located upstream of the pilot stand. In this region, rising cross-sectional differences lie within a range of between a minimum and maximum value of approximately 5%. These cross-sectional differences are then largely compensated or equalized in the downstream single line intermediate train, leading however to velocity differences which must be reduced in particularly the case of high finish-rolling velocities.

It is therefore an object of the invention to improve a rolling mill for wire or bar steel to overcome, in a simple way, some of the difficulties and technical limits caused by uneven temperature distribution across the bar length and the bar cross-section and the varying finishing velocities.

SUMMARY OF THE INVENTION

These and other objects of the invention which shall become apparent hereafter, are achieved by the Rolling Mill for Wire or Bar Steel With a Continuous Light Section Steel or Wire Train comprising a single or multi line breakdown train with a pilot stand, at least one single line intermediate train, downstream of the breakdown train, having a cooling distance with a following soaking zone, a group of intermediate stands, as well as a finishing train with a single line group of finishing stands located downstream of the intermediate train.

Specifically in the rolling train, a first soaking distance, with a 180° loop of the rolled stock is guided through a first horizontal loop former disposed between the pilot stand and the group of intermediate stands. A second soaking distance with a second 180° loop of the rolling stock is guided through a second horizontal loop former disposed between the group of intermediate stands and the group of finishing stands.

In the present invention, by the formation of horizontal loops, the travel distance of the rolled stock is more than doubled and, in some cases, trebled, with unchanged spatial distance between a breakdown train and finishing train. In this manner, the travel length between the breakdown train and the finishing train can be selected to be larger without increasing the length of the hall or shop.

The lengthened travel period of the rolled stock helps achieve satisfactory temperature compensation between the core and the surface when using a water box in the soaking distance. The lengthening of the travel distance also through formation of a horizontal 180° loop applies also to the distance between the group of intermediate stands and the finishing train. Because of possible temperature regulation of the rolled stock by the water box, the stock enters the group of finishing stands at a uniform temperature across the bar length and cross-section. A complete recrystallization of the rolled stock is possible with appropriately selected spacing within the loop or from one loop former to the other former because of the increased travel time.

Because of the large travel length capacity of the 180° loop, it is possible to hold the velocity in the group of finishing stands constant during the passage of a bar, overcoming many of the difficulties with multi-line trains and especially the problems observed at the delivery from the finishing stand. Multi-line trains can be operated, according to the invention, in the same manner as single line trains and the end velocity can be increased without raising the malfunction rate.

BRIEF DESCRIPTION OF THE DRAWING

The sole FIGURE depicts schematically the rolling mill for wire or bar steel with a continuous light section steel or wire train.

DETAILED DESCRIPTION OF THE PREFERRED AND ALTERNATE EMBODIMENTS

Rolled stock 30, 30*a* leaves the pilot stand 2 of the breakdown train 1. Its cross-section fluctuates within a range of approximately 5%, because of unavoidable longitudinal pull between the stands upstream of the breakdown train 1, as well as the pilot stand 2. Velocity differences result because these cross-sectional variations are compensated in the downstream single line intermediate train 5 by the group of intermediate stands 3. These differences are now equalized or compensated in a first 180° loop 25 which, in the invention, is located upstream of the intermediate group of stands 3, within the lengthened first equalization of compensation length 10.

For the compensation, a first loop former 20 is disposed on rails, displaceable in the direction of the arrow 22 and equipped with a drive means for displacement or travel. The drive means (not shown in detail) is, for instance, configured as a pneumatic piston-cylinder unit, whose stroke length 22 can amount approximately to one meter.

The cross-sectional variations still remaining in the rolled stock leaving the intermediate group of stands 3 are subsequently compensated in the finish stand group 4 of the finishing train 6. This results in additional velocity differences, which are now, per the invention, compensated in the second 180° loop 26 by the thereby formed second compensation distance 11.

Furthermore, the travel length of the rolled stock 30, between the pilot stand 2 and the finishing train 6 is nearly trebled. This is achieved by having the rolling stock 30 passing the largest portion of this distance (a) once in direction of the arrows 31 from the right hand side to the left hand side and (b) after reversal in the first loop former 20 through 180° corresponding to the arrow 32 passing from the left hand side to the right hand side and (c) a third time again after redirection in the second loop former 21 through 180° for the third time corresponding to the direction of the arrow 33. Herein, we have a first compensation distance 10 and a second compensation distance 11 downstream of the first one.

A refinement of the invention provides that a water tank 12, located downstream of the pilot stand 2 and the compensation distance 10 constituted by the first 180° loop, can regulate the temperature of the rolled stock.

In the comparatively large travel distance resulting now because of the loop 25 within the first compensation distance, a temperature equalization between the core and the surface of the rolled stock can occur. The throughput distance between the pilot stand 2 and the group of finishing stands 4 of the finishing train 6 is so large, in view of the disposition of the two loops 25 and 26, that the rolled stock enters the group of finishing stands 4 with uniform temperature across both the length and cross-section of the bar. It is possible to maintain the velocity of the group of finishing stands constant throughout the passage of a bar because of the compensation capacity of the 180° loops caused by the mobility 22 of the loop formers 20, 21.

Another refinement of the invention is that at least one water tank 13 is located downstream of the group of intermediate stands 3 within the compensation distance 11, formed by the second 180° loop 26. Herein, a travel distance up to the entry into the finishing stand 4 of the finishing train 6 is located downstream of this water tank 13, which is adequate for the required temperature compensation between core and surface of the rolled stock to be assured.

A particularly appropriate arrangement results from disposing the group of intermediate stands 3, the loop formers 20, 21 and the 180° loops 25, 26, located between these, to be offset sideways next to the production line x—x connecting the breakdown train 1 and the finishing train 4.

An optimum utilization of the available space with unchanged length of the production workshop is achieved by arrangement of the two loop formers 20, 21 in antipodal position in such a way that the first loop former 20 is disposed a comparatively short distance upstream of the group of finishing stands 4 and the second loop former 21 is disposed a comparatively short distance downstream of the pilot stand 2 so as to be respectively offset outwardly next to these.

A very advantageous arrangement corresponding to what is shown in the drawing results in a two-line breakdown train 1 according to the invention in that two single line intermediate trains **5, 5*a* and finishing trains 4, 4*a* are located downstream of the breakdown train 1 in mirror image parallel disposition and each intermediate train 5, 5*a* comprises compensation lengths 10, 10*a* or 11, 11*a*, including two 180° loops 25, 25*a*; 26, 26*a*. In this configuration, the last stand of the breakdown train can also be configured as a pilot stand and, at the same time, the two finishing trains 6, 6*a* can operate as stationary stands at constant velocity, wherein all velocity differences, especially due to cross-sectional variations in the pilot stand and the consequent rolled stock length differences are corrected in 180° loop tables 25, 26, 25*a*, 26*a***.

While the preferred and alternate embodiments of the invention have been disclosed in detail, modifications and adaptations may be made thereto, without departing from the spirit and scope of the invention as delineated in the following claims:

What is claimed is:

1. A rolling mill for wire or bar steel having a continuous light-section or wire train, comprising:

a break-down train, having at least one line and a pilot stand;

at least one single line intermediate train, located downstream of said breakdown train and including a group of intermediate stands;

at least one finishing train, located downstream of said intermediate train and having a group of single line finishing stands;

a production line connecting said breakdown and finishing trains;

a first temperature compensation section, located between said pilot stand and said intermediate train and comprising a first horizontal loop former defined by a 180° loop for rolling stock;

a first water box, located downstream of said pilot stand and upstream of said first temperature compensation section;

a section temperature compensation section, located between said intermediate train and said finishing train and comprising a second horizontal loop former defined by a 180° loop for rolling stock; and a second water box, located downstream of said second temperature compensation section and upstream of said finishing train;

wherein said first and second horizontal loop formers are arranged opposite each other on opposite sides of said intermediate train, respectively; and wherein said intermediate train and said first and second horizontal loop formers are arranged adjacent to said production line and sidewise relative thereto.

2. The rolling mill of claim 1, wherein a longitudinal distance between said first horizontal loop former and said finishing train is less than a distance between said first horizontal loop former and said intermediate train, and wherein a longitudinal distance between said second horizontal loop former and said pilot stand is less than a distance between said second horizontal loop former and said intermediate train.

3. The rolling mill of claim 1, wherein said breakdown train is a two line train, said rolling mill, further comprising:

a second finishing train having a group of single line finishing stands and arranged parallel to said at least one finishing train; and a second single line intermediate train arranged parallel to said at least one intermediate train between said breakdown train and said second finishing train and having temperature compensation sections and a group of intermediate stands, which together form a mirror image of the temperature compensation sections and the group of intermediate stands of said at least one intermediate train.

4. The rolling mill of claim 3, wherein said pilot stand is a last stand in the breakdown train, wherein the two finishing trains operate at a constant velocity, and wherein all velocity differences caused by cross-sectional fluctuations in the pilot stand and thereby causing rolled stock length differences are compensated in the temperature compensation sections of said two intermediate trains.

* * * * *